US007883034B2

(12) United States Patent
Matsui et al.

(10) Patent No.: US 7,883,034 B2
(45) Date of Patent: Feb. 8, 2011

(54) ELECTROSTATIC ATOMIZING DEVICE AND AIR BLOWER USING THE SAME

(75) Inventors: Yasunori Matsui, Hirakata (JP); Kazumi Okawa, Hikone (JP); Atsushi Isaka, Hikone (JP); Shinya Murase, Hikone (JP); Tomohiro Yamaguchi, Yasu (JP)

(73) Assignee: Panasonic Electric Works Co., Ltd., Kadoma-shi (JP)

( * ) Notice: Subject to any disclaimer, the term of this patent is extended or adjusted under 35 U.S.C. 154(b) by 504 days.

(21) Appl. No.: 11/921,138

(22) PCT Filed: May 29, 2006

(86) PCT No.: PCT/JP2006/310645

§ 371 (c)(1),
(2), (4) Date: Nov. 27, 2007

(87) PCT Pub. No.: WO2006/129592

PCT Pub. Date: Dec. 7, 2006

(65) Prior Publication Data

US 2009/0236450 A1 Sep. 24, 2009

(30) Foreign Application Priority Data

Jun. 1, 2005 (JP) ..... 2005-161983

(51) Int. Cl.

| | |
|---|---|
| ***B05B 5/00*** | (2006.01) |
| ***F23D 11/32*** | (2006.01) |
| ***B03C 3/00*** | (2006.01) |
| ***A45D 20/12*** | (2006.01) |
| ***F29B 3/34*** | (2006.01) |

(52) U.S. Cl. ..... 239/695; 239/690; 96/27; 34/98; 34/253

(58) Field of Classification Search ..... 239/690–708, 239/416.5; 96/28, 27, 53, 71, 65; 261/107; 34/97, 96, 98, 250, 253, 254
See application file for complete search history.

(56) References Cited

U.S. PATENT DOCUMENTS 3,059,613 A * 10/1962 Nakaya ..... 118/624

(Continued)

FOREIGN PATENT DOCUMENTS

EP 0734779 10/1996

(Continued)

OTHER PUBLICATIONS

Office Action dated Apr. 9, 2009, issued on the corresponding Korean patent application No. 10-2007-7028298 and the brief English translation thereof.

(Continued)

*Primary Examiner*—Len Tran
*Assistant Examiner*—Justin Jonaitis
(74) *Attorney, Agent, or Firm*—Edwards Angell Palmer & Dodge LLP

(57) ABSTRACT

An electrostatic atomizing device, which is capable of increasing the generation of a fine mist, while suppressing abnormal discharge and the generation of ozone. This electrostatic atomizing device is equipped with a plurality of atomizing electrodes, to which a high voltage is applied by a single high voltage generating circuit, counter electrodes disposed so as to face the atomizing electrodes; and a liquid transfer means for transferring a liquid (e.g., water) to each of the atomizing electrodes. The atomizing electrodes are connected in parallel to the high voltage generating circuit, and a resistive element for suppressing discharge current is inserted between the high voltage generating circuit and each of the atomizing electrodes.

12 Claims, 4 Drawing Sheets

U.S. PATENT DOCUMENTS

| | | | | |
|---|---|---|---|---|
| 4,381,533 | A * | 4/1983 | Coffee | 361/228 |
| 5,337,963 | A | 8/1994 | Noakes et al. | |
| RE34,757 | E * | 10/1994 | Smith et al. | 204/452 |
| 2003/0033726 | A1 | 2/2003 | Saida | |
| 2004/0007000 | A1 * | 1/2004 | Takeda et al. | 62/78 |

FOREIGN PATENT DOCUMENTS

| | | |
|---|---|---|
| JP | 54-065745 | 5/1979 |
| JP | 5-345156 | 12/1993 |
| JP | 2000-176325 | 6/2000 |
| JP | 2003-059622 | 2/2003 |
| JP | 2004-008988 | 1/2004 |
| JP | 2005-103501 | 4/2005 |

OTHER PUBLICATIONS

Office Action dated Dec. 26, 2008, issued on the corresponding Chinese patent application and the English partial translation thereof.

* cited by examiner

ELECTROSTATIC ATOMIZING DEVICE AND AIR BLOWER USING THE SAME

BACKGROUND OF THE INVENTION

1. Field of the Invention

The present invention relates to an electrostatic atomizing device for atomizing a liquid by use of a high voltage and, more particularly, an electrostatic atomizing device for generating a charged fine particulate mist having a nanometer particle size.

2. Description of the Related Art

As an electrostatic atomizing device capable of atomizing a liquid through the use of Rayleigh fission caused by applying a high voltage to the liquid, for example, there is the one disclosed in Japanese Patent Early Publication No. 5-345156. This electrostatic atomizing device is mainly composed of a tank for storing the liquid, a capillary tube fitted in the tank, and a high voltage generator for applying a high voltage output to the liquid in the tank. The liquid is electrostatically sprayed as a fine particulate mist from a mist outlet provided at the tip of the capillary tube.

By the way, when this kind of electrostatic atomizing device is used for an air purifier or the like, it is needed to increase the mist generation amount as a room requiring air purification becomes larger. For example, as the simplest method for increasing the mist generation amount, it is considered to use a plurality of electrostatic atomizing devices. However, this results in an increase in size and cost of the air purifier as a whole. On the other hand, the mist generation amount can be increased by applying a higher voltage (i.e., increasing discharge current), while ensuring a sufficient supply amount of the liquid. However, there is another problem such as the occurrence of abnormal discharge or an increase in the generation of ozone.

SUMMARY OF THE INVENTION

In consideration of the above problems, a primary concern of the present invention is to provide an electrostatic atomizing device capable of increasing the generation of a fine particulate mist of a liquid (e.g., water), while suppressing abnormal discharge and the generation of ozone.

The electrostatic atomizing device of the present invention comprises a high voltage generating circuit, a plurality of atomizing electrodes, to which a high voltage is applied by the high voltage generating circuit, a counter electrode disposed at a position facing each atomizing electrode, and a liquid transfer means configured to transfer a liquid to each atomizing electrode, and wherein the high voltage generating circuit is a single high voltage generating circuit, the plurality of atomizing electrodes are connected in parallel to the single high voltage generating circuit, and a resistive element for suppressing discharge current is inserted between the single high voltage generating circuit and each of the atomizing electrodes.

According to the above configuration, even when variations in electric field concentration occur at the tip of the atomizing electrode according to the distance difference between each of the atomizing electrodes and the counter electrode and the shape of the atomizing electrode, the resistive element inserted between each of the atomizing electrodes and the high voltage generating circuit causes a voltage drop to regulate the interelectrode voltage between each of the atomizing electrodes and the counter electrode, thereby uniformly stabilizing the discharge state for electrostatic atomizing. As a result, it is possible to increase the generation amount of the fine mist between the each of the atomizing electrodes and the counter electrode, while suppressing the occurrence of abnormal discharge (e.g., metal discharge) and the generation of ozone.

In the electrostatic atomizing device described above, each of the atomizing electrodes may have a convex curved surface at its tip. It is effective to reduce the electric field concentration at the tip of the atomizing electrode. In addition, even when a supply amount of the liquid to the atomizing electrode decreases, an increase in discharge current can be suppressed. As a result, it is possible to prevent an increase in ozone generation amount.

The resistive element inserted between the single high voltage generating circuit and the atomizing electrode located at the largest distance from the counter electrode may have a resistance value smaller than the resistive element(s) inserted between the single high voltage generating circuit and the other atomizing electrode(s). In this case, by inserting the resistive element having an appropriate resistance value between each of the atomizing electrodes and the high voltage generating circuit according to the distance difference, electrostatic atomizing can be achieved under a stable discharge condition.

In the electrostatic atomizing device described above, the resistive element may comprise a variable resistor. In this case, it is possible to respond flexibly to a change in electrostatic atomizing condition, and readily control the electrostatic atomizing condition.

In addition, the electrostatic atomizing device may comprise a needle-like electrode for ion generation connected to the single high voltage generating circuit, and a second resistive element inserted between the single high voltage generating circuit and the needle-like electrode, and the second resistive element has a resistance value larger than the resistive elements inserted between the single high voltage generating circuit and the atomizing electrodes. According to this configuration, it is possible to provide the fine mist generated by electrostatic atomizing and ions (e.g., minus ions) at the same time.

The electrostatic atomizing device described above may comprise a tank for storing the liquid to be atomized, and the liquid transfer means is formed by a flexible material, and connected at its one end to one of the atomizing electrodes and at its opposite end to the tank. In this case, it is possible to increase a degree of freedom of layout design of the tank in an electric equipment (e.g., an air blower such as hair dryer or air purifier) having the electrostatic atomizing device therein. As a result, there is an advantage that a reduction in size of the electric equipment is achieved. In addition, when the liquid transfer means uses the capillary phenomenon to transfer the liquid, it is possible to efficiently and stably transfer the liquid to the atomizing electrode by use of the liquid head pressure.

A further concern of the present invention is to provide an air blower using the electrostatic atomizing device described above. That is, the air blower of the present invention comprises the above-mentioned electrostatic atomizing device with the variable resistor, a blower means, and a switch configured to switch an air blowing amount of the blower means, and is characterized in that a resistance value of the variable resistor is switched in response to an operation of the switch.

According to this air blower, there is an advantage that an appropriate electrostatic atomizing state can be automatically obtained according to the air blowing condition.

Further characteristics of the present invention and advantages brought thereby will be clearly understood from the best mode for carrying out the invention described below.

DETAILED DESCRIPTION OF EXEMPLARY EMBODIMENTS

An electrostatic atomizing device and an air blower using the same device of the present invention are explained below in detail according to exemplary embodiments.

Figure 1:
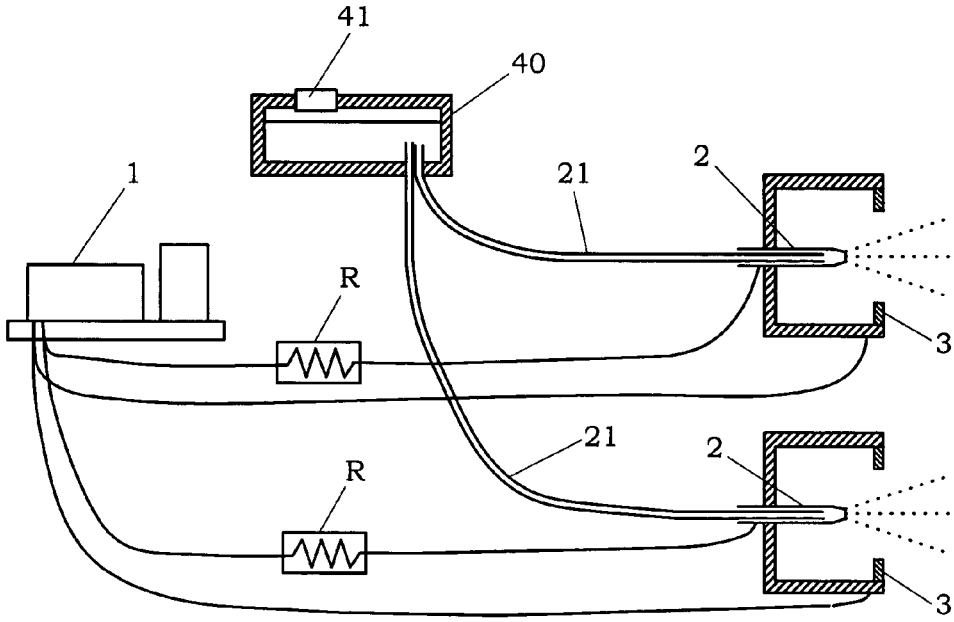
FIG. 1 is a schematic diagram of an electrostatic atomizing device according to a preferred embodiment of the present invention.

As shown in FIG. 1, the electrostatic atomizing device of the present embodiment is formed with a high voltage generating circuit 1, a plurality of atomizing electrodes 2 (two atomizing electrodes in the drawing) connected in parallel to the high voltage generating circuit 1, a counter electrode 3 provided at a position facing each atomizing electrode, a tank 40 for storing a liquid such as water, a liquid transfer member 21 for transferring the liquid to each atomizing electrode, and a resistive element R connected between each of the atomizing electrodes 2 and the high voltage generating circuit 1. In the present embodiment, for example, it is possible to use the high voltage generating circuit 1 capable of generating a negative voltage of several kV. In FIG. 1, the numeral 41 designates a liquid compensating port for replenishing the liquid into the tank 40.

Figure 2A:
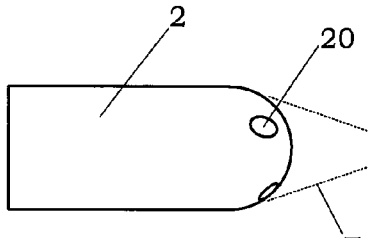
FIGS. 2A and 2B are side and end views of an atomizing electrode used in the electrostatic atomizing device.
Figure 2B:
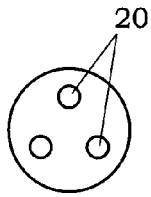

As shown in FIGS. 2A and 2B, each of the atomizing electrodes 2 used in the present embodiment is formed in a hollow structure and has a smoothly convex curved surface at its tip. In addition, a plurality of small apertures 20 are formed in the tip so as to be communicated with the interior space of the atomizing electrode 2. The opposite end of the atomizing electrode 2 is connected to the tank 40 through the liquid transfer member 21. The atomizing electrode 2 can be preferably made of a metal material having rust prevention property such as stainless steel.

On the other hand, the counter electrode 3 is configured in a ring shape, and connected to ground. The generated charged fine particulate mist is sprayed outside through an internal opening of the ring shape. From the standpoint of preventing electric shock, it is preferred to dispose a cover (not shown) having a lattice shape at the internal opening of the counter electrode. In this case, to prevent that the cover is electrically charged by the charged fine particulate mist, it is preferred that the cover is made of an antistatic material such as a silicon material, an organic boron compound, and a high molecular resin composition. A voltage sufficiently smaller than the voltage applied to the atomizing electrode 2 may be applied to the counter electrode 3.

The tank 40 used as a liquid supply portion may be directly connected to each of the atomizing electrodes 2 without using the liquid transfer member 21. In this case, the tank 40 functions as the liquid transfer means. In the case of installing the electrostatic atomizing device in an electric equipment, when the atomizing electrode 2 is connected to the tank 40 through the liquid transfer member 21 having flexibility, it is possible to increase a degree of freedom of layout of the tank 40. In addition, when the liquid is supplied from a single tank to the atomizing electrodes 2 through the use of a plurality of liquid transfer members 21, there are advantages that a reduction in size of the electrostatic atomizing device as a whole is achieved, and it becomes easy to replenish the liquid in the tank 40 or check the remaining amount of the liquid in the tank 40.

In addition, when the tank 40 is disposed at a higher position than the atomizing electrode 2, it is possible to stably supply the liquid to the atomizing electrode 2 with help of the liquid head pressure. To supply an appropriate amount of the liquid to the discharge space, and prevent a leakage of the liquid from the atomizing electrode 2, it is preferred that a diameter of the aperture 20 is determined such that a surface tension of the liquid (e.g., water) at the aperture 20 is larger than the liquid head pressure (e.g., water head pressure) applied to the aperture 20 by the liquid in the tank 40 filled with the liquid. As an example, when the liquid is water, it is preferred that a diameter of a round aperture is not larger than 0.5 mm, and a vertical distance of the tank 40 relative to the atomizing electrode 2 is not larger than 60 mm (more preferably, not larger than 55 mm). It is also preferred that a valve is formed in the tank 40 such that the internal pressure becomes a slightly negative pressure against the atmospheric pressure.

To supply the liquid to the atomizing electrode 2, a cooling means such as Peltier device for cooling the atomizing electrode 2 may be used to cause condensation on the atomizing electrode from the moisture in the air. In this case, the cooling means functions as the liquid transfer means. Since a reduction in size of the tank is achieved, or the tank can be omitted, it is effective to further downsize the electric equipment mounting the electrostatic atomizing device.

In the electrostatic atomizing device described above, when a high voltage is applied to each of the atomizing electrodes 2, the liquid supplied from the tank 40 to the interior of the atomizing electrode 2 reaches the outer surface of the tip portion of the atomizing electrode 2 through the apertures 20 formed in the tip of the atomizing electrodes 2, as shown in FIG. 2A, so that a Taylor cone T develops at the vicinity of the tip of the atomizing electrode 2. At a tip portion of the Taylor cone T, the liquid is burst due to its own high charge density, atomized to a fine droplet mist, and scattered through the internal opening of the ring-like counter electrode 3. That is, the atomizing electrode 2 becomes a negative electrode, so that electric charges gather in the vicinity of the tip of the atomizing electrode 2. On the other hand, the liquid transferred from the tank 40 by the capillary phenomenon of the liquid transfer member 21 is exposed to the discharge space between the atomizing electrode 2 and the counter electrode 3 through the apertures 20 of the atomizing electrode 2. Under these conditions, the Taylor cone T develops at the tip of the atomizing electrode 2. In the Taylor cone T, the liquid is exposed to a high electric field, and Rayleigh fission is repeatedly caused to generate the charged fine particulate mist of the liquid (e.g., water) having a particle size of, for example, 3 nm to 100 nm. The generated mist is sprayed outside through the internal opening of the counter electrode 3.

By the way, it is a rare case that the distances between the atomizing electrodes 2 and the counter electrodes 3 are absolutely equal to each other. Under normal conditions, variations in interelectrode distance occur to some extent. In addition, even when the distances between the atomizing electrodes 2 and the counter electrodes 3 are absolutely equal to each other, there is a case that electric discharge easily occurs at one of the atomizing electrodes 2 than the other atomizing electrodes. This means that variations in electric-field concentration 2 occur at the tips of the atomizing electrodes.

Figure 3A:
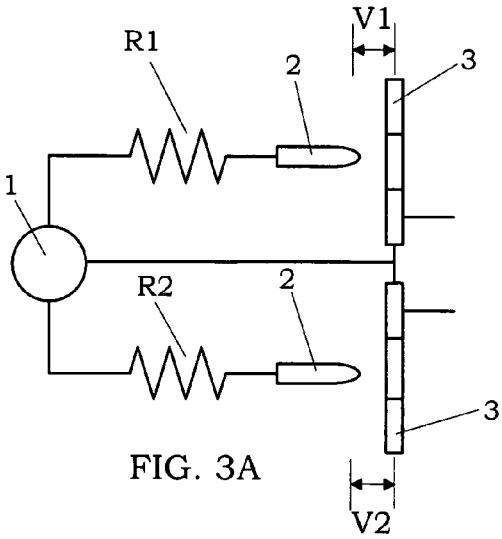
FIG. 3A is a schematic circuit diagram of the electrostatic atomizing device.
Figure 3B:
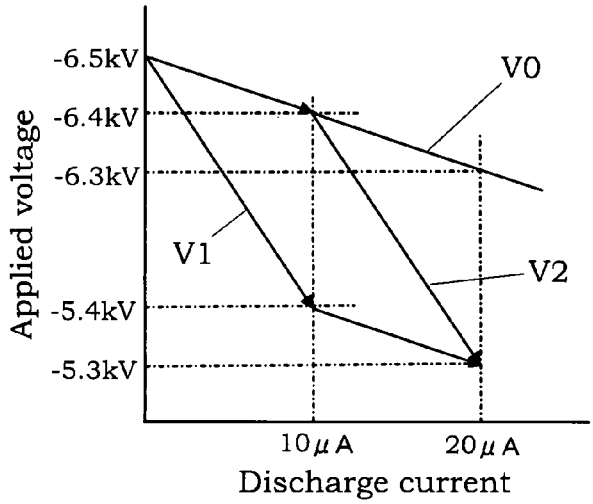
FIG. 3B is a graph showing a relation between discharge current and applied voltage.

However, in the present invention, because the resistive element R is connected between each of the atomizing electrodes 2 and the high voltage generating circuit 1, it is possible to suppress the occurrence of the variations described above. That is, as shown in FIGS. 3A and 3B, when each of the resistive elements (R1, R2) has a high resistance value of more than several MΩ, for example, 10 to 600 MΩ, interelectrode voltages (V1, V2) between the atomizing electrodes 2 and the counter electrodes 3 can be regulated by voltage drops caused by the existence of these resistive elements (R1, R2) to uniformly stabilize the discharge state. In addition, since the discharge current is suppressed, it is possible to suppress the generation of ozone. FIG. 3B shows the case where the resistive elements (R1, R2) have the resistance value of 100 MΩ. In addition, "V0" in FIG. 3B shows a voltage of the high voltage generating circuit.

Figure 4:
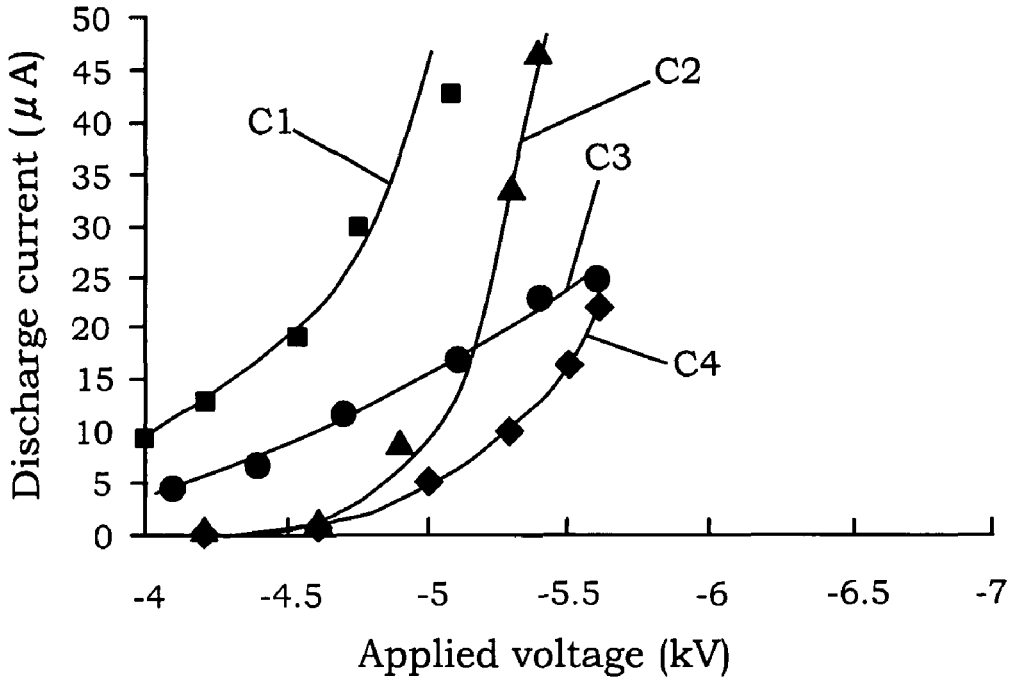
FIG. 4 is a graph showing relations between discharge current and applied voltage.
Figure 5:
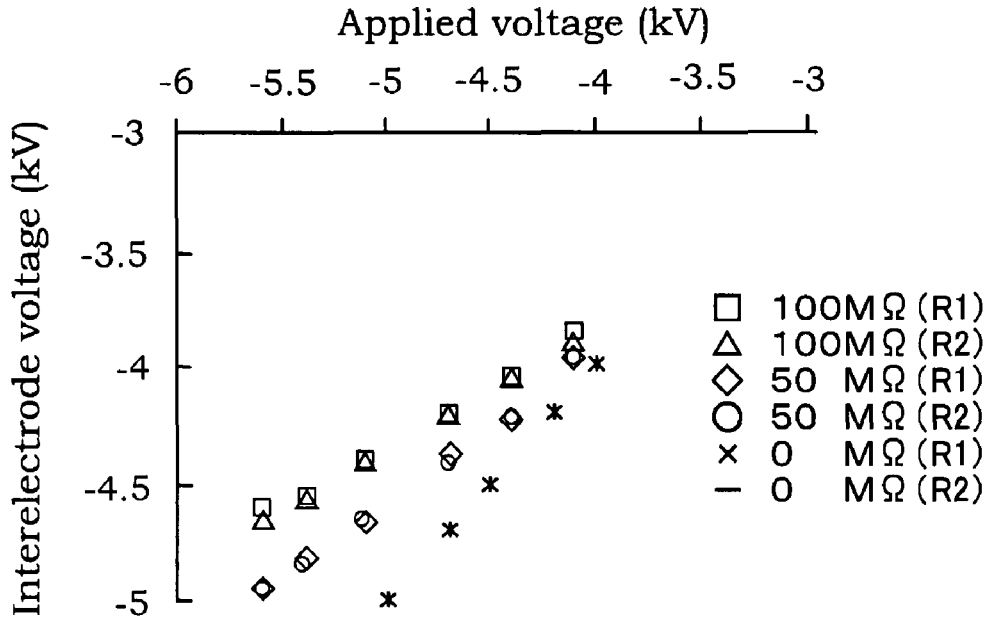
FIG. 5 is a graph showing relations between applied voltage and interelectrode voltage.

In addition, FIG. 4 shows relations between applied voltage and discharge current under different conditions. In this drawing, C1 designates a relation between the applied voltage and the discharge current in the absence of the resistive element and in the presence of the liquid. C2 designates a relation between the applied voltage and the discharge current in the absence of the resistive element and the liquid. C3 designates a relation between the applied voltage and the discharge current in the presence of the liquid and the resistive element of 50 MΩ. C4 designates a relation between the applied voltage and the discharge current in the absence of the liquid and in the presence of the resistive element of 50 MΩ. In addition, FIG. 5 shows relations between applied voltage and interelectrode voltage with respect to different resistance values of the resistive elements (R1, R2).

As described above, in the present embodiment, since the atomizing electrode 2 has the smoothly convex curved surface at its tip, a difference in discharge current value caused by the distance difference between electrodes or the difference between the presence or absence of the liquid at the tip of the atomizing electrode 2 becomes small. As a result, the effect obtained by inserting the resistive element becomes remarkable.

Figure 6:
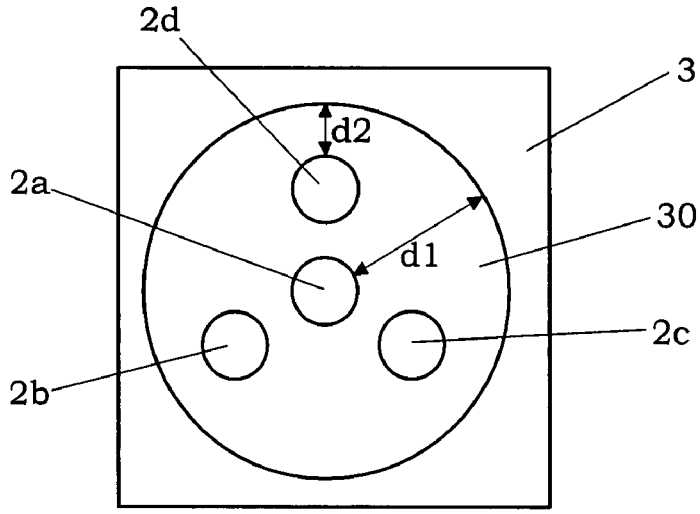
FIG. 6 is a plan view showing a positional relation of a plurality of atomizing electrodes and a counter electrode.

As shown in FIG. 6, when a common counter electrode 3 configured in a ring-like shape to have a circular opening 30, and four atomizing electrodes (2*a*, 2*b*, 2*c*, 2*d*) are arranged such that the atomizing electrode 2*a* is located at the center of the circuit opening 30, and the remaining three atomizing electrodes (2*b*, 2*c*, 2*d*) are located on a concentric circle of the circular opening 30, a distance d1 between the atomizing electrode 2*a* and the counter electrode 3 becomes larger than the distance d2 between the other atomizing electrode (2*b*, 2*c*, 2*d*) and the counter electrode 3. In such a case, to achieve uniform electrostatic atomizing of the liquid, it is preferred that the resistance value of the resistive element inserted between the atomizing electrode 2*a* and the high voltage generating circuit 1 is smaller than the resistance value of the resistive element inserted between the other atomizing electrode (2*b*, 2*c*, 2*d*) and the high voltage generating circuit 1. In addition, since the counter electrode 3 is shared among the atomizing electrodes, it is effective to further downsize the electric equipment mounting the electrostatic atomizing device.

Figure 7:
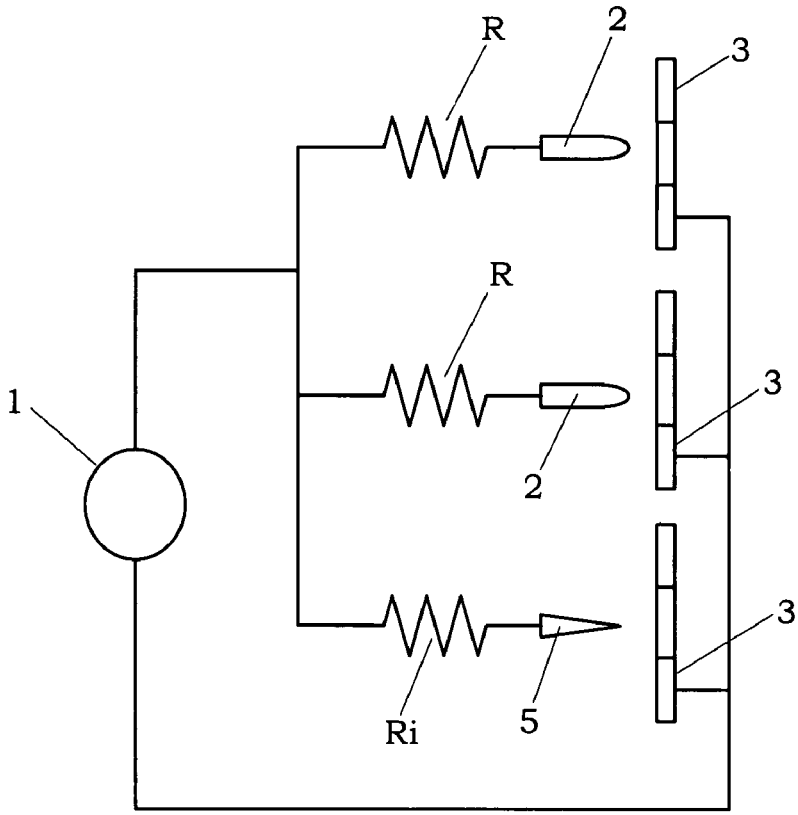
FIG. 7 is a schematic circuit diagram of an electrostatic atomizing device having a needle-like electrode for ion generation according to a preferred embodiment of the present invention.

In addition, as shown in FIG. 7, the electrostatic atomizing device may have an ion generating portion, which is formed with a needle-like electrode 5 connected to the high voltage generating circuit 1 and a counter electrode 3. When the atomizing electrodes 2 and the needle-like electrode 5 are connected in parallel to the high voltage generating circuit 1, it is preferred that a resistive element Ri connected between the needle-like electrode 5 and the high voltage generating circuit 1 has a larger resistance value than the resistive element R connected between the atomizing electrodes 2 and the high voltage generating circuit 1. In brief, it is preferred to suppress the discharge current flowing in the needle-like electrode 5 by use of the resistive element Ri having the larger resistance value than the resistive element R. Thereby, it is possible to stabilize the discharge state between the needle-like electrode 5 and the counter electrode 3 as well as the discharge state between the atomizing electrode 2 and the counter electrode 3, and efficiently and stably generate both of minus ions and the charged fine particulate mist.

Figure 8:
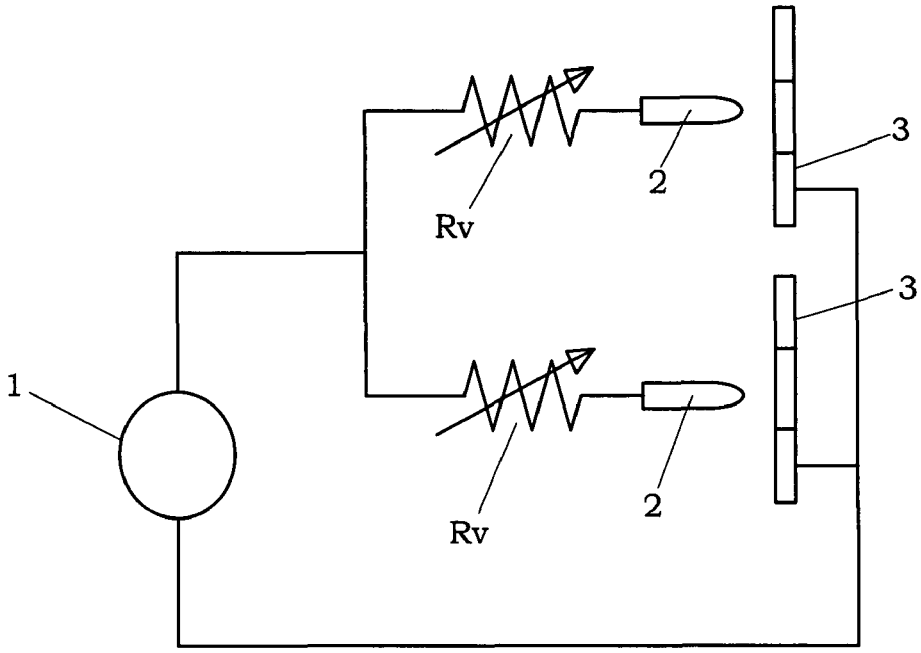
FIG. 8 is a schematic circuit diagram of an electrostatic atomizing device having a variable resistor according to a preferred embodiment.

In addition, as shown in FIG. 8, a variable resistor Rv can be used as the resistive element. Alternatively, means for selectively switching one of a plurality of resistive elements having different resistance values may be used as the resistive element. In this case, it becomes possible to control the mist generation amount in response to the supplying state of the liquid to the atomizing electrode 2, and a change in temperature or humidity of ambient temperature. In addition, at least one of the resistive elements may be formed by the variable resistor Rv.

Figure 9:
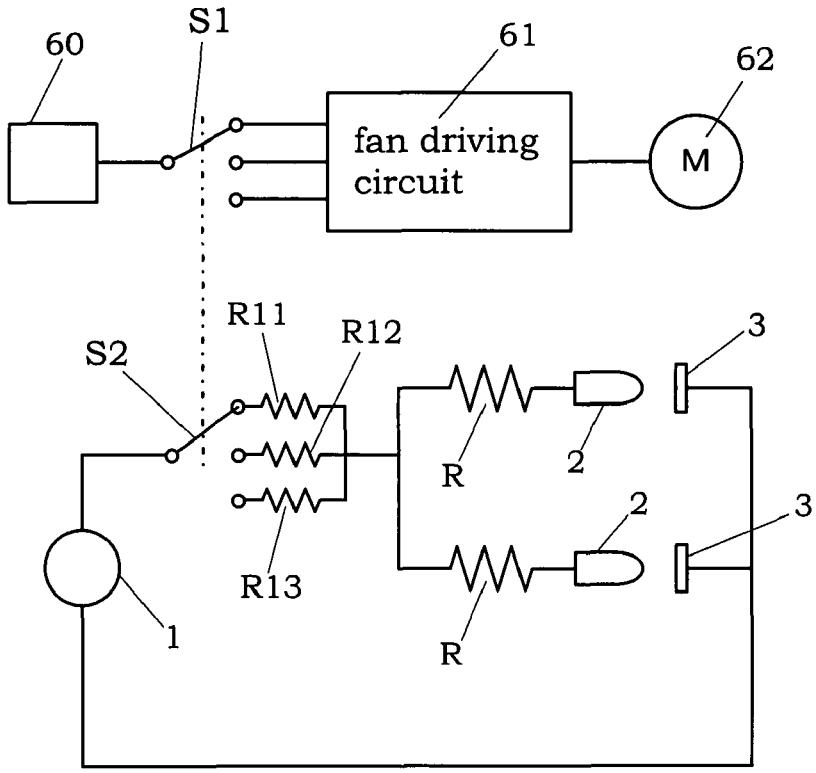
FIG. 9 is a schematic circuit diagram of an air blower using the electrostatic atomizing device according to a preferred embodiment of the present invention.

Next, it is explained about a case that the electrostatic atomizing device described above is mounted in an air blower. As shown in FIG. 9, this air blower is characterized in that a switch S2 for switching among a plurality of resistive elements (R11, R12, R13) having different resistance values is interlocked with an operation of a switch S1 for changing an air blowing amount of the air blower. In this case, since the interelectrode voltage changes depending on the resistance value, it becomes possible to adjust the electrostatic atomizing amount. That is, the electrostatic atomizing device can be controlled such that the mist generation amount is increased when the air blowing amount is large, and the mist generation amount is decreased when the air blowing amount is small. Thus, the air blower shown in FIG. 9 has a function of automatically controlling the mist generation amount in response to the air blowing amount. In FIG. 9, the numeral 60 designates an electric source at the air blower side, the numeral 61 designates a fan driving circuit of the air blower, and the numeral 62 designates a motor for the fan. The electrostatic atomizing device is expected to be used for the air blower such as hair dryers and air purifiers. However, it goes without saying that the electrostatic atomizing device can be used for the other electric equipments having the potentiality of effectively utilizing the fine mist generated by the electrostatic atomizing device.

INDUSTRIAL APPLICABILITY

As described above, according to the present invention, the resistive element inserted between each of the atomizing electrodes connected in parallel and the single high voltage generating circuit appropriately regulates the interelectrode voltage between the atomizing electrode and the counter electrode. Therefore, it is possible to prevent variations in discharge resulting from the distance difference between the atomizing electrode and the counter electrode, and the shape of the atomizing electrode. In addition, by suppressing the discharge current, it is possible to reduce the generation of ozone and avoid the occurrence of abnormal discharge such as metal discharge.

Thus, the electrostatic atomizing device of the present invention capable of increasing the generation of a fine mist under a stable discharge condition is expected to be used in wide application fields typified by an air blower such as hair dryer and air purifier.

The invention claimed is:

1. An electrostatic atomizing device comprising:

a high voltage generating circuit;

a plurality of atomizing electrodes, to which a high voltage is applied by said high voltage generating circuit;

a counter electrode disposed at a position facing each of said atomizing electrodes; and a liquid transfer means configured to transfer a liquid to said atomizing electrode;

wherein said high voltage generating circuit is a single high voltage generating circuit, the plurality of said atomizing electrodes are connected in parallel to said single high voltage generating circuit, and a plurality of resistive elements for suppressing discharge current, wherein one of said resistive elements is inserted between said single high voltage generating circuit and each of the atomizing electrodes, wherein the resistive element inserted between said single high voltage generating circuit and the atomizing electrode located at the largest distance from said counter electrode has a resistance value smaller than the resistive element(s) inserted between said high voltage generating circuit and the other atomizing electrode(s).

2. The electrostatic atomizing device as set forth in claim 1, wherein each of the atomizing electrodes has a convex curved surface at its tip.

3. The electrostatic atomizing device as set forth in claim 1, wherein the resistive element comprises a variable resistor.

4. The electrostatic atomizing device as set forth in claim 1, further comprising a needle-like electrode for ion generation connected to said single high voltage generating circuit, and a second resistive element inserted between said single high voltage generating circuit and said needle-like electrode, wherein the second resistive element has a resistive value larger than the resistive elements inserted between said single high voltage generating circuit and the atomizing electrodes.

5. The electrostatic atomizing device as set forth in claim 1, wherein said liquid transfer means is formed by a flexible material, and connected at its one end to one of the atomizing electrodes and at its opposite end to a tank for storing said liquid.

6. An air blower using an electrostatic atomizing device comprising:

the electrostatic atomizing device set forth in claim 3;

a blower means; and a switch configured to switch an air blowing amount of said blower means;

wherein a resistance value of said variable resistor is switched in response to an operation of said switch.

7. An electrostatic atomizing device comprising:

a high voltage generating circuit;

a plurality of atomizing electrodes, to which a high voltage is applied by said high voltage generating circuit;

a counter electrode disposed at a position facing each of said atomizing electrodes; and a liquid transfer means configured to transfer a liquid to said atomizing electrode, wherein said high voltage generating circuit is a single high voltage generating circuit, the plurality of said atomizing electrodes are connected in parallel to said single high voltage generating circuit, and a plurality of resistive elements for suppressing discharge current, wherein one of said resistive elements is inserted between said single high voltage generating circuit and each of the atomizing electrodes, wherein said plurality of resistive elements inserted between said single high voltage generating circuit and each of said atomizing electrodes have resistance values, respectively, said resistance values of said resistive elements are determined by distances between the atomizing electrodes and the counter electrodes which corresponds to the atomizing electrodes or individual shapes of the atomizing electrodes.

8. The electrostatic atomizing device as set forth in claim 7, wherein each of the atomizing electrodes has a convex curved surface at its tip.

9. The electrostatic atomizing device as set forth in claim 7, wherein the resistive element comprises a variable resistor.

10. The electrostatic atomizing device as set forth in claim 7, comprising:

a needle-like electrode for ion generation connected to said single high voltage generating circuit, and a second resistive element inserted between said single high voltage generating circuit and said needle-like electrode wherein the second resistive element has a resistance value larger than the resistive elements inserted between said single high voltage generating circuit and the atomizing electrodes.

11. The electrostatic atomizing device as set forth in claim 7, wherein said liquid transfer means is formed by a flexible material, and connected at its one end to one of the atomizing electrodes and at its opposite end to a tank for storing said liquid.

12. An air blower using an electrostatic atomizing device comprising:

the electrostatic atomizing device set forth in claim 9;

a blower means; and a switch configured to switch an air blowing amount of said blower means;

wherein a resistance value of said variable resistor is switched in response to an operation of said switch.

* * * * *